US007861720B1

(12) United States Patent
Wolcott

(10) Patent No.: US 7,861,720 B1
(45) Date of Patent: Jan. 4, 2011

(54) AXILLARY SUPPORT CUSHION DEVICE

(75) Inventor: Jane Wolcott, Greenville, SC (US)

(73) Assignee: Mizuho Orthopedic Systems, Inc, Union City, CA (US)

( * ) Notice: Subject to any disclaimer, the term of this patent is extended or adjusted under 35 U.S.C. 154(b) by 211 days.

(21) Appl. No.: 12/071,419

(22) Filed: Feb. 21, 2008

(51) Int. Cl.

| | |
|---|---|
| ***A61G 15/00*** | (2006.01) |
| ***B68G 5/00*** | (2006.01) |
| ***A47C 20/02*** | (2006.01) |
| ***A47C 16/00*** | (2006.01) |

(52) U.S. Cl. ..... 128/845; 5/652; 5/655.9

(58) Field of Classification Search ..... 128/845, 128/846; 5/630, 632, 652, 655.9, 646
See application file for complete search history.

(56) References Cited

U.S. PATENT DOCUMENTS 5,076,264 A * 12/1991 Lonardo et al. ..... 602/19
5,163,194 A * 11/1992 Dixon ..... 5/636

* cited by examiner

*Primary Examiner*—Patricia M Bianco
*Assistant Examiner*—Tarla R Patel
(74) *Attorney, Agent, or Firm*—Theodore J. Bielen, Jr.

(57) ABSTRACT

A patient axillary support cushion utilizing a first member having a base, a first leg, and a second leg. First and second legs are connected to the base to form a channel for placement adjacent the axilla of a patient. The first leg is shorter than the second leg and is intended to allow the placement of endotracheal tubes. A second member formed of softer material overlies the channel formed by the elements of the first member. The second member may include convoluted surface characteristics for pressing the skin of the patient.

3 Claims, 2 Drawing Sheets

AXILLARY SUPPORT CUSHION DEVICE

BACKGROUND OF THE INVENTION

The present invention relates to a novel and useful support cushion for a medical patient.

Patients undergoing surgery or other medical procedures are often supported in certain position for extended periods of time. Axillary supports such as pillows or rolls have been used in the past in order to aide in this endeavor. However, it has been found that the prior supports do not achieve the desired results, especially providing lateral stability. In addition, prior support devices have not prevented the development of decubitus ulcers. The latter is especially acute with respect to patients located in intensive care units. Moreover, relieving pressure on a patient, especially one in a lateral position, necessary to prevent multiple medical problems such as an ischemia, nerve damage, dermatological conditions and the like. Prior make-shift supports have proved inadequate, in this regard.

A patient axillary support cushion for overcoming the problems found in the prior art would be a notable advance in the medical field.

BRIEF SUMMARY OF THE INVENTION

In accordance with the present invention a novel and useful axillary support cushion device is herein provided.

The device of the present invention utilizes a first member formed of a flexible material. The first member possesses a base and depending first and second legs. The first leg is constructed to have a shorter extension from the base member than the second leg. The first and second leg form a channel for placement adjacent the axilla of a patient. In essence, the first leg lies along the front or chest of the patient while the longer second leg extends along the back portion of the patient when the patient is in a lateral position.

A second member is also found in the present invention. The second member includes a piece of material having a softness which is greater than that of the first member. The second member overlies the inner surface of the first member at the channel formed by the first and second legs relative to the base. The first member is intended to directly contact the axilla of the patient. The first member may also include a convoluted surface to allow the passage of air between the skin of the patient and the support cushion of the present invention. In this aspect, the second member may include a plurality of protuberances on its surface.

The first and second members may be formed of a polymeric foam material. Also, the density of the polymeric foam material of the second member is less than the density of the polymeric material of the first member.

It may be apparent that a novel and useful axillary support cushion device as hereinabove described.

It is therefore an object of the present invention to provide a cushion device which is particularly useful with patients receiving medical treatment.

Another object of the present invention is to provide a support cushion device which includes a generally u-shaped configuration and may be used when it is centered under the axilla of the patient.

Another object of the present invention is to provide a support cushion device which may be used with a medical patient and includes a pair of legs that closely follow the contours of the patient's chest and back.

Another object of the present invention is to provide a support cushion device which is particularly useful with medical patients and includes a structure which accommodates the use of endo-tracheal tubes.

A further object of the present invention is to provide a support cushion device for a medical patient which relieves pressure on the dependent shoulder and aids in lateral stability when the patient is in a lateral position on a surface.

Another object of the present invention is to provide a support cushion device which relieves compression on the axillary artery and brachial plexus, thus reducing the possibility of ischemia and nerve damage while a patient is located in a hospital facility.

Another object of the present invention is to provide a support cushion device which results in increased comfort to the patient, reducing the need for anesthesia medication.

Another object of the present invention is to provide a support cushion device for a medical patient which allows the performance of lateral surgical procedures by medical practitioners through the stabilization of the thorax region of the patient to reduce slumping.

Yet another object of the present invention is to provide a support cushion device which aids in the positioning of patients in intensive care units to prevent the formation of the decubitus ulcers.

A further object of the present invention is to provide a support cushion device which stabilizes a patient during x-ray procedures.

The invention possesses other objects and advantages especially as concerns particular characteristics and features thereof which will become apparent as the specification continues.

For a better understanding of the invention reference is made to the following detailed description of the preferred embodiments of the invention which should be taken in conjunction with the above described drawings.

DETAILED DESCRIPTION OF THE PREFERRED EMBODIMENTS OF THE INVENTION

Various aspects of the present invention will evolve from the following detailed description of the preferred embodiments thereof which should be referenced to the prior delineated drawings.

Figure 1:
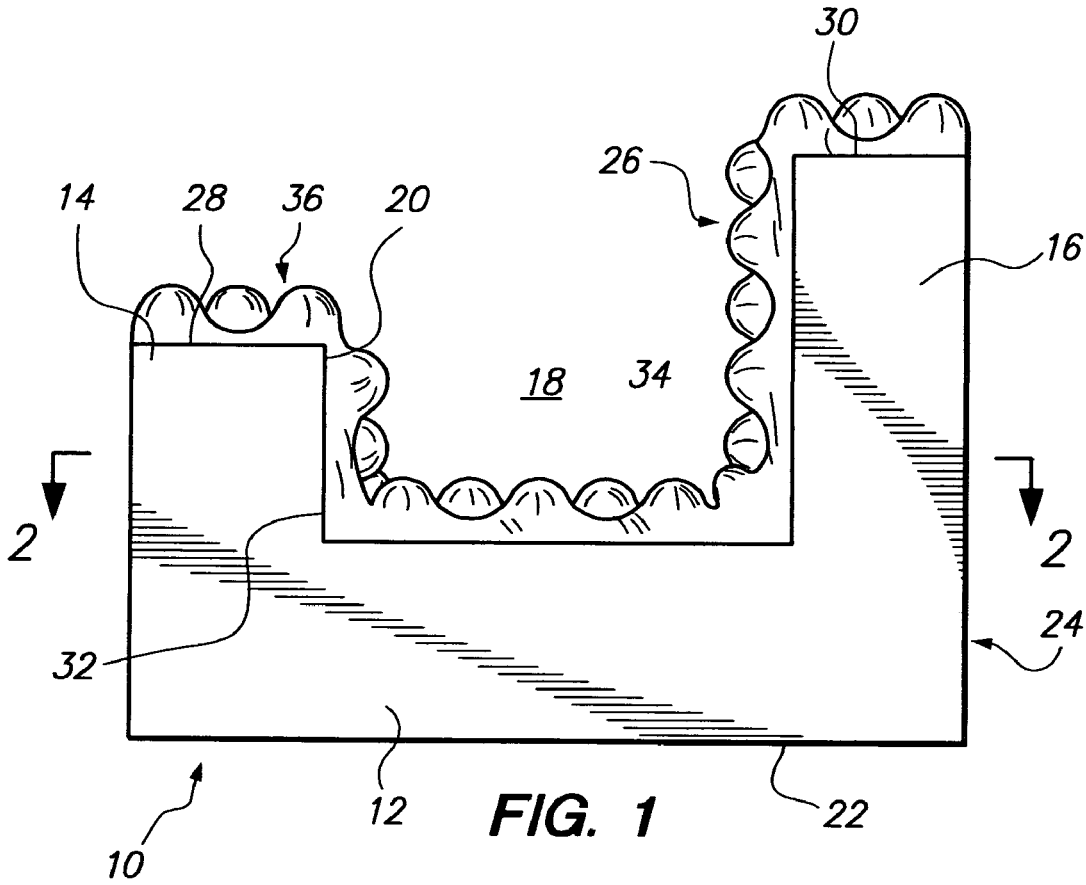
FIG. 1 is a front elevational view of the device of the present invention.

With reference to FIG. 1, an embodiment of the invention is shown and is noted in its entirety by reference character 10. Axillary support cushion 10 is particularly useful with medical patients who are placed in a lateral configuration, FIG. 3, and will be discussed hereinafter. Cushion device 10 includes as one of its elements a base 12. A first leg 14 and a second leg 16 depend or extend from base 12. With reference to FIG. 1, it may apparent that leg 14 is shorter than leg 16, the purpose of which will be discussed as specification continues. First and second legs 14 and 16 form a channel 18 relative to base 12. As depicted in the drawings, base 12, first leg 14, and second leg 16 take the form of rectangular solids. However, other suitable shapes may be employed with respect to cushion device 10 such as rounded or faceted members. Moreover, cushion device 10 includes an inner surface 20 adjacent channel 18 and an outer surface 22. Base 12, first leg 14, and second leg 16 form a first member 24.

A second member 26 is also employed in the present invention as part of cushion device 10. Second member 26 is fashioned of a piece of material having a softness which is greater than that of first member 24. Second member 26 overlies inner surface 20 in channel 18 of first member 24 and extends over end surfaces 28 and 30 of first leg 14 and second leg 16, respectively. Second member 26 possesses a first surface 32 and a second surface 34. First surface 32 of second member 26 contacts and is generally fixed relative to inner surface 20 of first member 24. Second surface 34 of second member 26 may include a convoluted pattern such that a plurality of protuberances are exposed thereat.

Figure 2:
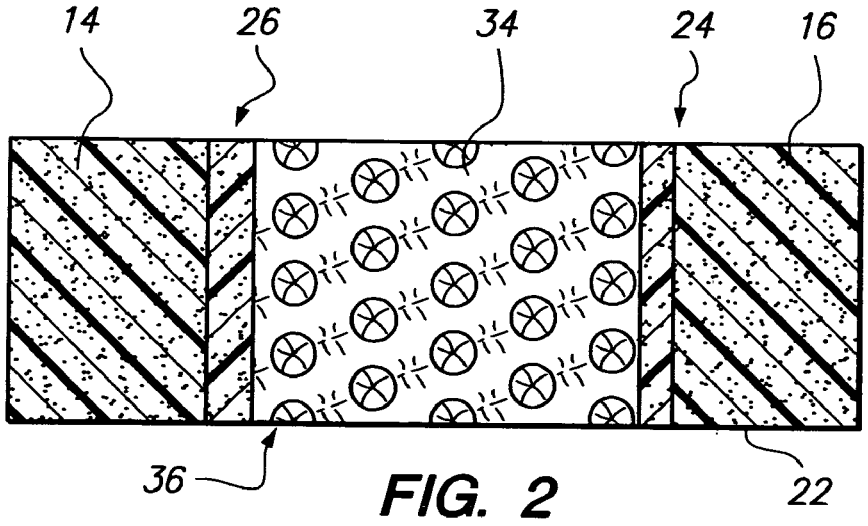
FIG. 2 is a sectional view taken along line 2-2 of FIG. 1.

Turning to FIG. 2, it may be observed that first member 24, as well as second member 26, may be formed of a foam polymeric material. For example, a polyurethane foam material may suffice in this regard.

However, it should be noted that the density of the polymeric foam material of first member 24 is greater than the density of polymeric foam material of second member 26. In fact, second member 26, as previously noted, is softer to the touch than first member 24. For example, the density of the polymeric foam material of first member 24 may lie between 1.7-1.8 pounds per cubic foot. On the other hand, the density of second member 26 may lie in the range of 1.35-1.45 pounds per cubic feet.

Figure 3:
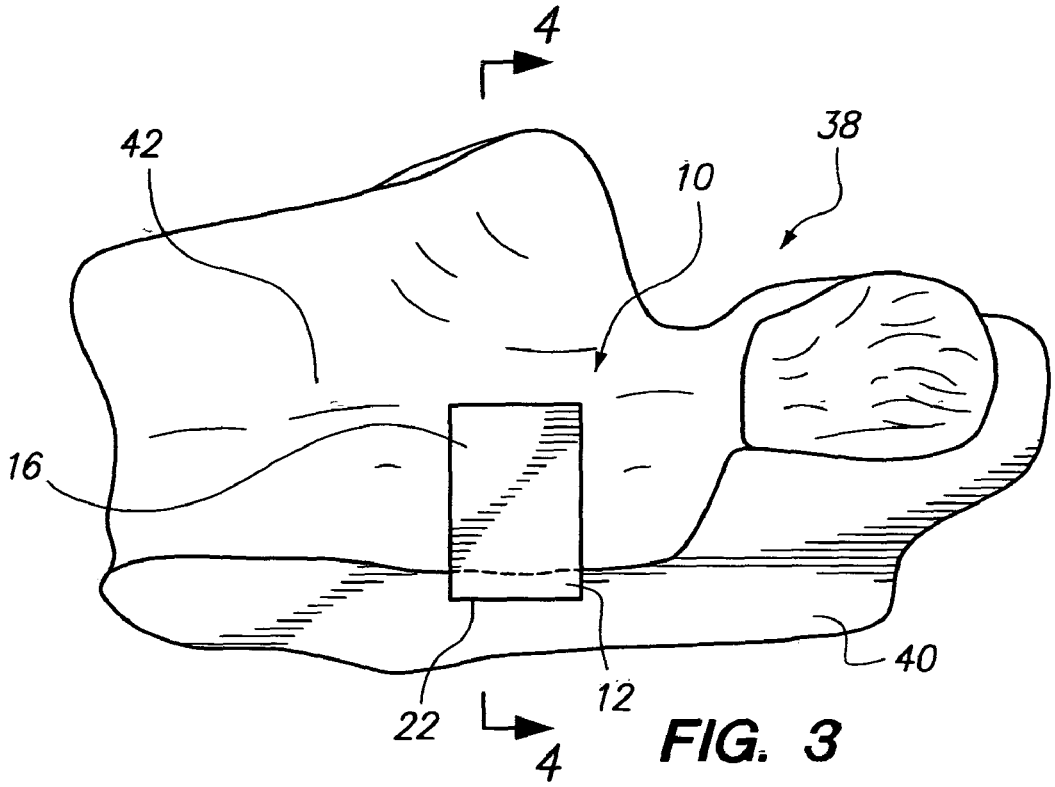
FIG. 3 is a partial rear elevational view of a patient having the device of the present invention placed thereupon.
Figure 4:
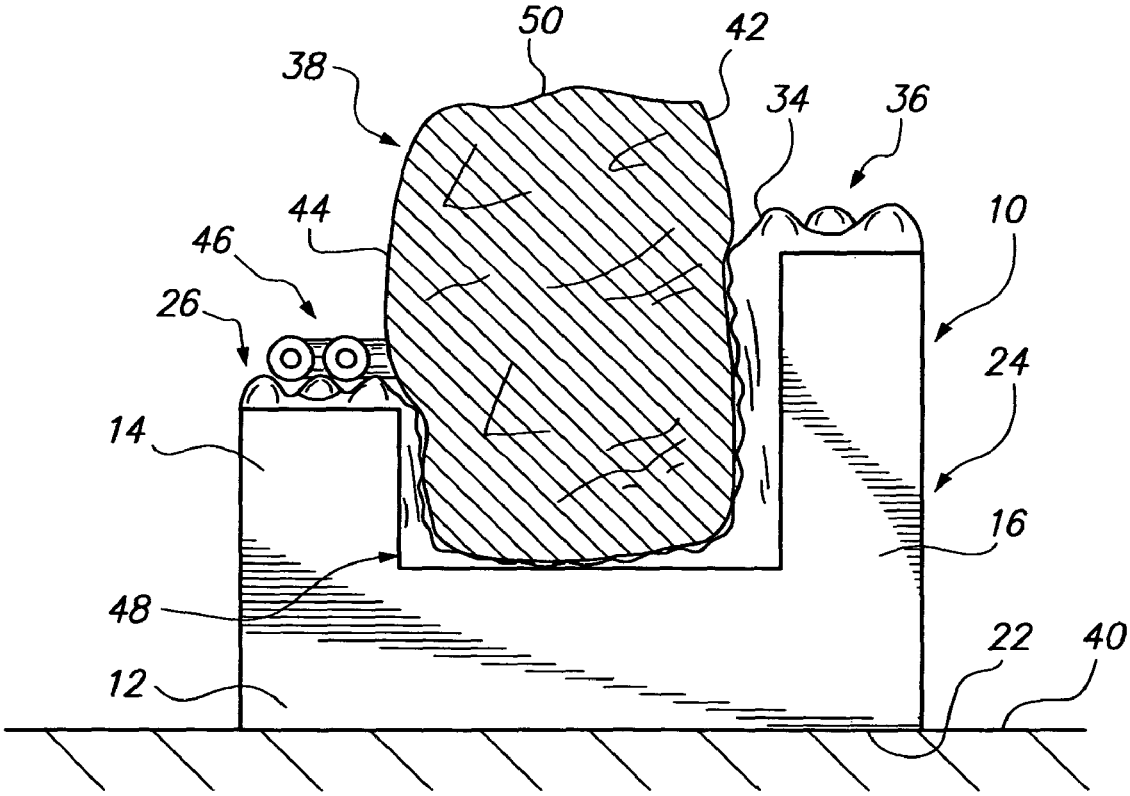
FIG. 4 is a sectional view taken along line 4-4 of FIG. 3.

In operation, turning to FIGS. 3 and 4, it may be seen that device 10 is in place on a patient 38 who is lying in a lateral position on a surface 40, which may be a bed or operating table. In viewing FIG. 3, it may be apparent that long leg 16 of cushion device 10 extends up the back 42 of patient 38. On the other hand, short leg 14 extends along the chest or thorax 44 of patient 38, FIG. 4 Surface 22 of first member 24 contacts surface 40 and prevents the patient 38 from moving therealong. Needless to say, legs 14 and 16 of cushion device 10 stabilizes the patient 38 in the lateral position, as depicted in FIGS. 3 and 4. Most notably, surface 34 of second member 26 contacts or presses the axilla or arm pit region of patient 38 directly or through an article of clothing. Plurality of protuberances 36 slightly compress under the weight of patient 38 but tend to allow a multiplicity of air spaces 48 between the skin 50 of patient 38 and surface 34 of second member 26. Thus, second member 26 provides comfort to patient 38, as well as permitting the passage of air between the skin 50 of patient 38 and second member 26. Shortened leg 14 is also compatible with the use of endo-tracheal tubes 46 near chest 44 of patient 38, such tubes 46 are often employed with respect to the medical treatment afforded patient 38. In general, second member 26 provides comfort to patient 38 while first member 24 provides stability to patient 38 in the lateral position with respect to surface 40, as depicted in the drawings.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. An axillary support cushion device, for a prone patient, comprising:

a. a first member formed of a flexible material, said first member including a base, a first leg, and a second leg, said first and second legs being connected to and extending from said base, said base and said first and second legs forming a channel for placement adjacent the axilla of the prone patient, said first member having an outer surface and an inner surface at said channel; said first leg being shorter in extension from said base than said second leg, said first leg intended to extend along the thorax of the patient, said second leg intended to extend along the back of the patient; and b. a second member, said second member comprising a piece of material having a softness greater than said first member, said second member overlying said inner surface of said first member, said second member further including a first surface and a second surface, said first surface of said second member contacting said inner surface of said first member, said second surface of said second member being exposed to contact the axilla of the patient, said first member comprising an element formed of a polymeric foam of a certain density, said second member comprising an element formed of a polymeric foam having a density less than said certain density of said first element.

2. The device of claim 1 in which said base and said first and second legs of said first member comprise rectangular solids.

3. The device of claim 2 in which said second surface of said second member includes a plurality of protuberances.

* * * * *